US009990891B2

(12) United States Patent
Yamada et al.

(10) Patent No.: US 9,990,891 B2
(45) Date of Patent: Jun. 5, 2018

(54) CONTROL DEVICE, DISPLAY DEVICE, AND METHOD OF CONTROLLING DISPLAY DEVICE

(75) Inventors: Yusuke Yamada, Matsumoto (JP); Kota Muto, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 317 days.

(21) Appl. No.: 13/214,167

(22) Filed: Aug. 20, 2011

(65) Prior Publication Data

US 2012/0044232 A1 Feb. 23, 2012

(30) Foreign Application Priority Data

Aug. 23, 2010 (JP) ..... 2010-186338

(51) Int. Cl.
*G09G 3/36* (2006.01)
*G09G 3/34* (2006.01)

(52) U.S. Cl.
CPC ..... *G09G 3/344* (2013.01); *G09G 2310/04* (2013.01); *G09G 2320/0252* (2013.01); *G09G 2320/0257* (2013.01)

(58) Field of Classification Search
CPC ..... G09G 3/36; G09G 3/231; G09G 3/232
USPC ..... 345/107, 211; 359/296
See application file for complete search history.

(56) References Cited

U.S. PATENT DOCUMENTS 7,315,294 B2 * 1/2008 Richards ..... G09G 3/346 345/691
7,317,437 B2 * 1/2008 Huang ..... G09G 3/3651 345/87
2005/0057479 A1 * 3/2005 Richards ..... G09G 3/346 345/98

(Continued)

FOREIGN PATENT DOCUMENTS

CN 102376269 A 3/2012
EP 2 387 025 A2 11/2011

(Continued)

OTHER PUBLICATIONS

International Search Report dated Aug. 9, 2011 as received in related application No. PCT/JP2011/004513.

(Continued)

*Primary Examiner* — Temesghen Ghebretinsae
*Assistant Examiner* — Paras D Karki
(74) *Attorney, Agent, or Firm* — Maschoff Brennan

(57) ABSTRACT

A control device that controls the driving of a display device which changes display states by a writing operation of applying a driving voltage several times, wherein the control device includes a determining portion that determines whether or not the writing operation is performed for each pixel; and a control portion that starts the writing operation in the pixel in which the writing operation is determined to be performed by the determining portion, the writing operation including applying, wherein, in a case where a previous writing operation is not performed on the pixel in which the writing operation is determined to be performed by the (Continued)

determining portion, the control portion starts the writing operation, and in a case where the previous writing operation is performed on the pixel, the control portion starts the next writing operation after the previous writing operation is finished.

10 Claims, 7 Drawing Sheets

(56) References Cited

U.S. PATENT DOCUMENTS

| | | | | |
|---|---|---|---|---|
| 2006/0097982 | A1* | 5/2006 | Arai | G09G 3/38 345/105 |
| 2006/0170648 | A1* | 8/2006 | Zhou | G09G 3/344 345/107 |
| 2007/0205978 | A1 | 9/2007 | Zhou et al. | |
| 2007/0296690 | A1 | 12/2007 | Nagasaki | |
| 2008/0309674 | A1* | 12/2008 | Barrus | G09G 3/344 345/545 |
| 2009/0040201 | A1 | 2/2009 | Kim et al. | |
| 2009/0256798 | A1 | 10/2009 | Low et al. | |
| 2011/0001748 | A1 | 1/2011 | Rutman et al. | |
| 2011/0084979 | A1* | 4/2011 | Rutman | G09G 3/344 345/589 |
| 2012/0044276 | A1 | 2/2012 | Yamada | |

FOREIGN PATENT DOCUMENTS

| | | | |
|---|---|---|---|
| JP | 2009-192786 | A | 8/2009 |
| JP | 2009-251615 | A | 10/2009 |
| JP | 2010-044508 | A | 2/2010 |
| JP | 2010-164888 | A | 7/2010 |
| WO | 2010/018698 | A1 | 2/2010 |

OTHER PUBLICATIONS

Supplementary European Search Report dated Oct. 30, 2014 as received in Application No. 11 81 9555.

* cited by examiner

0% → 33%

T1

| INDEX | 3 | 2 | 1 |
|---|---|---|---|
| DRIVING VOLTAGE VALUE | $V_w$ | $V_w$ | $V_n$ |

0% → 67%

T2

| INDEX | 5 | 4 | 3 | 2 | 1 |
|---|---|---|---|---|---|
| DRIVING VOLTAGE VALUE | $V_w$ | $V_w$ | $V_w$ | $V_w$ | $V_n$ |

0% → 100%

T3

| INDEX | 7 | 6 | 5 | 4 | 3 | 2 | 1 |
|---|---|---|---|---|---|---|---|
| DRIVING VOLTAGE VALUE | $V_w$ | $V_w$ | $V_w$ | $V_w$ | $V_w$ | $V_w$ | $V_n$ |

33% → 0%

T4

| INDEX | 3 | 2 | 1 |
|---|---|---|---|
| DRIVING VOLTAGE VALUE | $V_b$ | $V_b$ | $V_n$ |

33% → 67%

T5

| INDEX | 8 | 7 | 6 | 5 | 4 | 3 | 2 | 1 |
|---|---|---|---|---|---|---|---|---|
| DRIVING VOLTAGE VALUE | $V_w$ | $V_w$ | $V_w$ | $V_w$ | $V_n$ | $V_b$ | $V_b$ | $V_n$ |

33% → 100%

T6

| INDEX | 5 | 4 | 3 | 2 | 1 |
|---|---|---|---|---|---|
| DRIVING VOLTAGE VALUE | $V_w$ | $V_w$ | $V_w$ | $V_w$ | $V_n$ |

67% → 0%

T7

| INDEX | 5 | 4 | 3 | 2 | 1 |
|---|---|---|---|---|---|
| DRIVING VOLTAGE VALUE | $V_b$ | $V_b$ | $V_b$ | $V_b$ | $V_n$ |

67% → 33%

T8

| INDEX | 8 | 7 | 6 | 5 | 4 | 3 | 2 | 1 |
|---|---|---|---|---|---|---|---|---|
| DRIVING VOLTAGE VALUE | $V_w$ | $V_w$ | $V_n$ | $V_b$ | $V_b$ | $V_b$ | $V_b$ | $V_n$ |

67% → 100%

T9

| INDEX | 3 | 2 | 1 |
|---|---|---|---|
| DRIVING VOLTAGE VALUE | $V_w$ | $V_w$ | $V_n$ |

100% → 0%

T10

| INDEX | 7 | 6 | 5 | 4 | 3 | 2 | 1 |
|---|---|---|---|---|---|---|---|
| DRIVING VOLTAGE VALUE | $V_b$ | $V_b$ | $V_b$ | $V_b$ | $V_b$ | $V_b$ | $V_n$ |

100% → 33%

T11

| INDEX | 5 | 4 | 3 | 2 | 1 |
|---|---|---|---|---|---|
| DRIVING VOLTAGE VALUE | $V_b$ | $V_b$ | $V_b$ | $V_b$ | $V_n$ |

100% → 67%

T12

| INDEX | 3 | 2 | 1 |
|---|---|---|---|
| DRIVING VOLTAGE VALUE | $V_b$ | $V_b$ | $V_n$ |

FIG. 2

CONTROL DEVICE, DISPLAY DEVICE, AND METHOD OF CONTROLLING DISPLAY DEVICE

BACKGROUND

1. Technical Field

The present invention relates to a technique for writing an image to a desired display state through several voltage applications.

2. Related Art

In a display device such as an electrophoretic display device, there is a device that performs one write using a plurality of frames. Such a writing is performed when a display element requires a relatively long time for a change of display state (that is, a gradation) or the like. When such a writing is performed, if one writing is not finished (that is, if the time for multiple frames has not elapsed), the display element cannot start the next writing.

JP-A-2009-251615 discloses a technique for writing an image for each partial region by a pipeline processing in a display device such as an electrophoretic display device. This permits the writing to start in a region where the writing is not performed without relying on the writing of other regions. Thus, in some cases, it is possible to reduce the time required for the writing as compared to the case of writing the whole image.

In the case of the technique described in JP-A-2009-251615, in order to write a plurality of regions in parallel, it is necessary to have as many pipelines as there are regions. In other words, in the technique described in JP-A-2009-251615, the number of regions capable of being rewritten in parallel is limited by the number of pipelines. Furthermore, in the technique described in JP-A-2009-251615, when a region, where a writing target exists, overlaps with another region, if the writing of the region where the writing target exists is not finished, it is difficult to start the writing of another region.

SUMMARY

An advantage of some aspects of the invention is to increase the regions where a writing operation can start, without relying on the previous writing operation, in a display device that writes an image through several voltage applications.

An aspect of the invention provides a control device that controls the driving of a display device which changes display states of a plurality of pixels from a first display state to a second display state by a writing operation of applying a driving voltage several times, the control device including a determination portion that determines whether or not the writing operation is performed for each pixel; and a control portion that starts the writing operation in the pixel in which the writing operation is determined to be performed by the determining portion, the writing operation including applying the driving voltage to the pixel several times in a pattern, the pattern being determined depending on the first display state and the second display state, wherein, in a case where a previous writing operation is not performed on the pixel in which the writing operation is determined to be performed by the determining portion, the control portion starts the writing operation, and in a case where the previous writing operation is performed on the pixel, the control portion starts the next writing operation after the previous writing operation is finished.

According to the control device, it is possible to control the starting of the writing operation of any pixel without relying on the writing operation state of another pixel.

It is preferable that, in the control device, the number of applications of the driving voltage in one writing operation differs depending on at least one of the first display state and the second display state.

According to this configuration, it is possible to rapidly finish the previous writing operation and rapidly start the next writing operation.

It is preferable that the control device includes a first recording portion that records data for specifying the number of applications of the driving voltage in the one writing operation for each pixel, the control portion determines whether or not the previous writing operation is performed, depending on whether or not the number specified by the data recorded by the first recording portion reaches a scheduled number.

According to this configuration, it is possible to start the next writing operation from the pixel to which the driving voltage is applied by a required number.

It is preferable that, when the previous writing operation is performed on the pixel for which the writing operation is determined to be performed, the determination portion performs the determination again after the previous writing operation is finished, and, when it is determined that the writing operation is not performed according to the repeated determination by the determining portion, the control portion does not perform the writing operation.

According to this configuration, it is possible to omit an unnecessary writing operation so as not to be performed.

It is preferable that the control device includes an acquisition portion that reads and acquires an image data from a first storage region which stores the image data showing display states to be displayed on each pixel by the plurality of pixels; and a second recording portion that records a scheduled data, which shows a scheduled display state to be displayed on each pixel when the writing operation is finished, by each pixel, the determining portion determines the pixel, in which the display state shown by the image data acquired by the acquisition portion is not consistent with the display state shown by the scheduled data, as a pixel in which the writing operation is performed.

According to this configuration, it is possible to easily specify the pixel in which the writing operation is performed.

It is preferable that the second recording portion rewrites the scheduled data for the pixel in which the writing operation is started by the control portion so that the image data becomes new scheduled data.

According to this configuration, the pixel, for which the writing operation does not need to be performed after the writing operation is finished, can be prevented from being determined as a pixel for which the writing operation is performed.

Another aspect of the invention provides a display device that includes the control device, and a display portion which has a plurality of pixels and performs the writing operation depending on the control by the control device.

According to the display device, it is possible to start the next writing operation from the pixel to which the driving voltage is applied the required number of times, and improve the exterior display speed for a user.

It is preferable that, in the display device, the pixels include a display element having a memory property.

According to this configuration, it is possible to suppress the electric power that is required for the maintenance of the display state of the pixel in which the writing operation does not need to be performed.

Still another aspect of the invention provides a control method by a section that controls the driving of a display device which changes the display states of a plurality of pixels from a first display state to a second display state by a writing operation of applying a driving voltage several times, the method including determining whether or not the writing operation is performed for each pixel, and controlling so that the writing operation is started in the pixel in which the writing operation is determined to be performed, the writing operation including applying the driving voltage several times in a pattern, the pattern being determined depending on the first display state and the second display state, wherein, in a case where a previous writing operation is not performed on the pixel in which the writing operation is determined to be performed, the writing operation is started, and in a case where the previous writing operation is performed on the pixel, the next writing operation is started after the previous writing operation is finished.

According to the control method, it is possible to start the next writing operation from the pixel to which the driving voltage is applied by a required number, and improve an exterior display speed of a user.

BRIEF DESCRIPTION OF THE DRAWINGS

The invention will be described with reference to the accompanying drawings, wherein like numbers reference like elements.

FIG. 2 is a diagram that shows a wave form table stored in a ROM.

DESCRIPTION OF EXEMPLARY EMBODIMENTS

Figure 1:
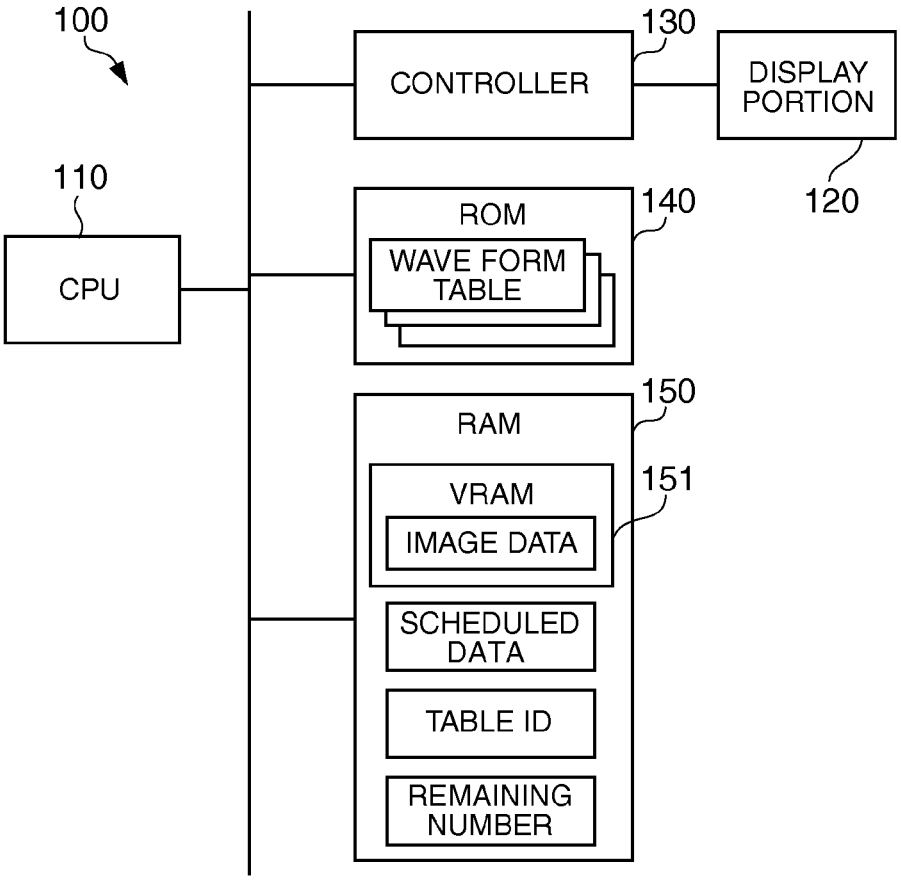
FIG. 1 is a block diagram that shows a main configuration of a display device.

FIG. 1 is a block diagram that shows a main configuration of a display device which is an embodiment of the invention. As shown in FIG. 1, a display device 100 includes a CPU (Central Processing Unit) 110, a display portion 120, a controller 130, a ROM (Read Only Memory) 140, and a RAM (Random Access Memory) 150. Furthermore, the RAM 150 includes VRAM (Video RAM) 151. Additionally, although it is not shown in the drawings, the display device 100 may include a section (a so-called memory card or the like) that stores image data or a section (a key, a touch screen or the like) that receives an operation of a user, and may include a section (an interface) that acquires the data from such sections.

The CPU 110 is a section to control the operation of the display device 100. The CPU 110 performs the reading or the writing of the data by executing the program stored in advance. The CPU 110 has a function of sequentially writing the image data on the VRAM 151.

Hence, the image data is data of a screen unit that shows the display states of each pixel. The image data shows the display state to be displayed on each pixel, but is sometimes not necessarily consistent with the actual display state.

The display portion 120 is a section to display the image by the plurality of pixels. In the present embodiment, the display portion 120 is a display section of an electrophoretic type, and uses an electrophoretic element in the display element. Herein, the electrophoretic element refers to a display element that has a memory property (a storage property). Furthermore, the memory property refers to a property that tries to keep the display state even if the voltage is not applied when a predetermined display state is generated by the application of the voltage, and is also referred to as bistability. The display state of the electrophoretic element includes two certain kinds of display states and a display state of a half tone. Two kinds of display states typically means combinations having a relatively large difference of reflectivity of light. However, as long as the combination is one in which the color is visually or mechanically distinguishable, the combination is not particularly limited. In the present embodiment, the display state of the maximum reflectivity is called "white", and the display state of the minimum reflectivity is called "black". Thus, the display state of the halftone is gray. Furthermore, in the present embodiment, the state, in which the image is not yet written such as immediately after putting the power source, is white.

The controller 130 is a section to control the driving of the display portion 120. The controller 130 corresponds to an example of the control device according to the embodiment of the invention. The controller 130 causes the display portion 120 to perform an operation (hereinafter, referred to as "writing operation") of applying a predetermined driving voltage to a display element using the data stored in the ROM 140 or the RAM 150. The writing operation of the present embodiment is performed by applying a plurality of driving voltages. That is, a first writing operation is performed by several applications of the voltage. In addition, the number or the pattern of applying the driving voltage differs depending on the display states of the pixel to be targeted.

The ROM 140 or the RAM 150 is a section that stores the data. The ROM 140 stores a plurality of wave form tables that shows the pattern of the driving voltage to be applied. Herein, the wave form refers to a temporal change of the gradation of the pixel, but is not limited to an undulating one such as a wave. In addition, the ROM 140 may be a storage section that is not read-only but is rewritable, such as EEPROM (Electronically Erasable and Programmable ROM) and can be substituted for a storage unit (RAM or the like) other than ROM.

FIG. 2 is a diagram that shows a wave form table stored in the ROM 140. The wave form table of the present embodiment is a data group in which an index corresponds to the driving voltage value. The index is data for specifying the number (hereinafter, referred to as "number of applications") of applications of the driving voltage during one writing operation, and is also the data for specifying the driving voltage of each time during the writing operation in the wave form table. The index of the present embodiment is a number by which the number of applications at that time is reduced from the total number of the required applications for the one writing operation specified by the wave form table. In addition, the number of applications required for the one writing operation differs depending on at least one of the gradation of the pixel before the writing and the gradation of the pixel after the writing. Furthermore, the driving voltage value is data that shows the driving voltage. The driving voltage values of the present embodiment are three kinds of Vb, Vw, and Vn. The driving voltage value Vb is a voltage value in which the display state of the pixel becomes closer to black, and the driving voltage value Vw is a voltage value in which the display state of the pixel becomes closer to white. Furthermore, the driving voltage value Vn is a voltage value in which a potential difference is not generated in the pixel. In addition, the number of applications required for the one writing operation is the same as the number of frames required for the one writing operation.

The wave form table shown in FIG. 2 is a case where the number of gradations is four. Herein, the gradation value of the pixel is indicated by a value in which the reflection density of the pixel is normalized, black is indicated by 0%, and white is indicated by 100%. Thus, the pixel having the gradation value of 33% is gray (dark gray) of gray near black, and the pixel having the gradation value of 67% is gray (light gray) of gray near white. Four gradations are realized by the wave form table of FIG. 2 (black, dark gray, light gray, and white).

For example, a wave form table T1 shown in FIG. 2 shifts the gradation of the pixel from the state of 0% to the state of 33%, applies the driving voltage value Vw to the first and second writing operations, and applies the driving voltage value Vn to the third writing operation to finish the writing operation. Hereinafter, the gradation value of the initial state of the pixel is referred to as the "initial value" and the gradation value immediately after the writing operation is referred to as the "objective value". For example, the wave form table T1 is a wave form table in which the initial value of the gradation value is 0%, and the objective value is 33%. The respective wave form tables can be made to correspond to the initial value and the objective value in advance, respectively.

In addition, the number of applications (that is, the maximum value of the index) required for the one writing operation is not limited to that shown. For example, the wave form table of the case of using the display element of a relatively gradual gradation change may be one in which the number of applications is increased so that the one writing operation takes even more time. Furthermore, by increasing the number of applications required for the one writing operation, the number of gradations can also be increased.

Figure 3:
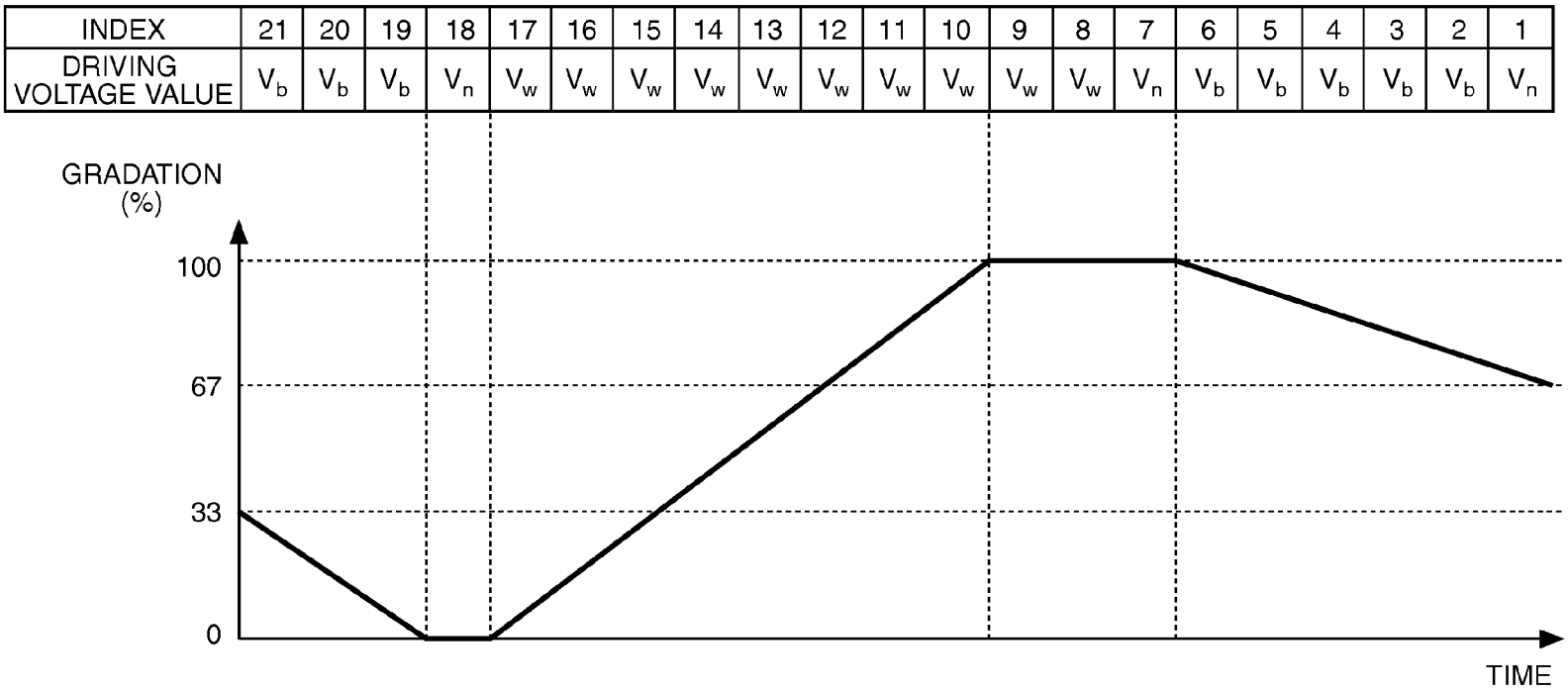
FIG. 3 is a schematic diagram that shows a gradation variation realized by a wave form table.

FIG. 3 is a schematic diagram that shows a gradation change realized by a voltage application according to the wave form table. In addition, in FIG. 3, for convenience of explanation, the number of applications per writing operation is 21, and the gradation change is linearly shown. However, the actual gradation change differs depending on the responsiveness or the like of the display element to the application voltage, and in some cases, a part or all of them is curved. Furthermore, the time required for the change of the gradation from black to white is not necessarily the same as the time required for the change from white to black. If the wave form table is used, various wave forms can be realized without being limited to that shown.

The example shown in FIG. 3 is an example of the wave form of the gradation change when the gradation value of the pixel is changed to 67% (light gray) in a case where the gradation value before the writing operation is 33% (dark gray). In this case, the controller 130 applies the voltage so that the gradation of the pixel temporarily becomes black, then applies the voltage so as to make the gradation become white, and applies the voltage so as to make the gradation become dark again, thereby realizing the gradation called light gray. In addition, if the time per frame (hereinafter, referred to as "frame period") is sufficiently short, such a gradation change is hardly perceived by the eyes of a user.

The display element such as an electrophoretic element can form a desired display state by applying a certain direction of voltage for a certain time. However, when the voltage is only applied in one direction, the reproducibility of the gradation is insufficient depending on the property of the display element, and a desired display state cannot be formed, or, in some cases, a so-called afterimage is displayed. The controller 130 permits the value of the driving voltage or the direction thereof for each frame period to be switched over by the use of the wave form table, which makes it possible to realize the wave forms of various shapes and reduce the afterimage or improve the reproducibility of the gradation. Furthermore, by suitably setting the wave form table, it is possible to prevent the voltage applied to the display element from being biased to one direction of the positive and negative directions.

The RAM 150 stores the scheduled data, a table ID and the remaining number. The scheduled data is data that shows a scheduled display state to be displayed on each pixel when the writing operation is finished. The scheduled data is data that can be rewritten in the pixel unit. That is, a scheduled data of any pixel is in a rewritable state if the writing operation is not performed on the pixel. The table ID is data for specifying the wave form table that is used in the writing operations of each pixel. The table ID can be allocated to each of the wave form tables in advance. The remaining number is a number by which the number of applications of that time is reduced from the total number of applications required for the one writing operation specified by the wave form table shown by the table ID, and is stored for each pixel. The remaining number of the present embodiment is the same as the value in which "1" is reduced from the index of the driving voltage value finally read from the wave form table, which is specified by the table ID, by the controller 130. If the remaining number is "0", it means that the writing operation of the corresponding pixel is finished (or the writing operation does not need to be performed).

The VRAM 151 functions as a frame buffer, and sequentially stores the image data supplied from the CPU 110. The image data can be collectively rewritten in a screen unit, that is, a unit of all the plurality of pixels that is a target of the driving, unlikely the scheduled data. The VRAM 151 is a memory region where both of the CPU 110 and the controller 130 can be accessed. More specifically, the VRAM 151 is a memory region where the CPU 110 can write to and the controller 130 can read from. In addition, VRAM 151 may be a part of the memory region of the RAM 150, but may be a memory section physically separated from the RAM 150. The VRAM 151 corresponds to an example of the first memory region according to the present embodiment.

Figure 4:
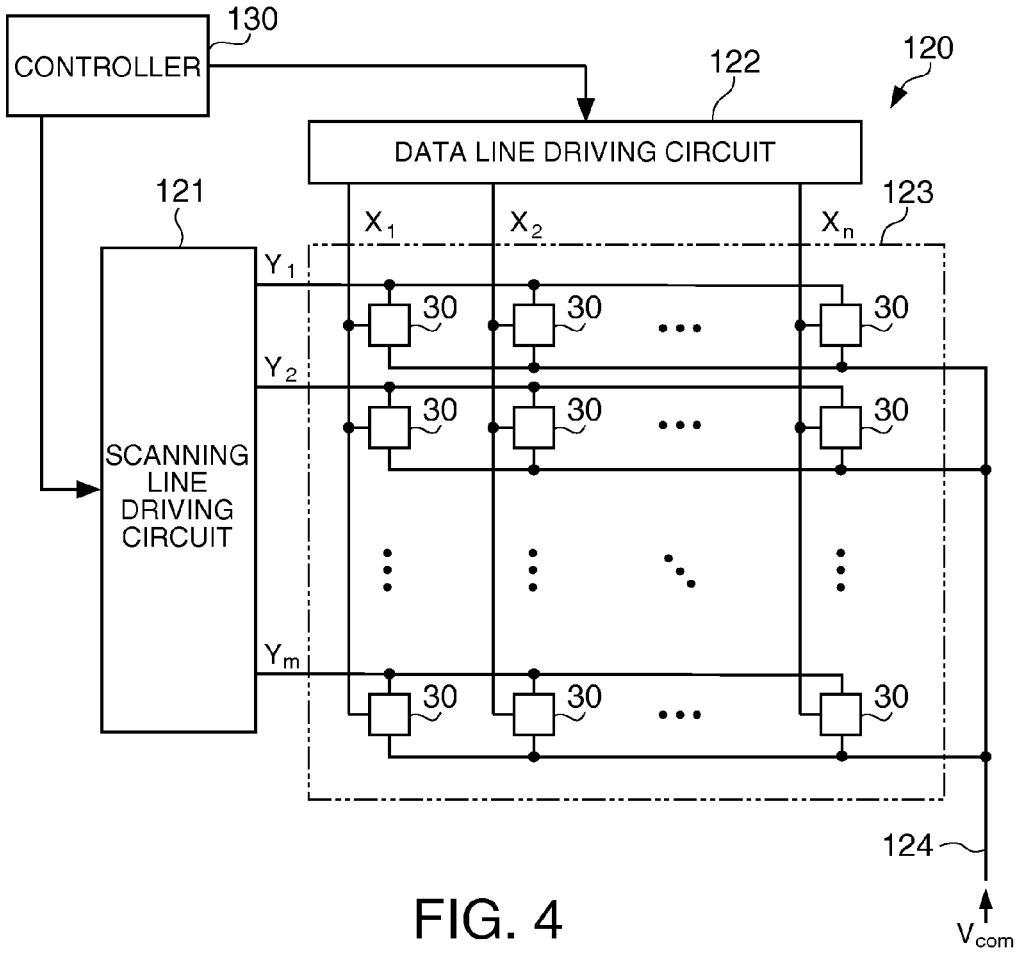
FIG. 4 is a diagram that shows a circuit configuration of a display portion.

FIG. 4 is a diagram that shows a circuit configuration of the display portion 120. As shown in FIG. 4, the display portion 120 includes a scanning line driving circuit 121, a data line driving circuit 122, and a display panel 123. The controller 130 controls the driving of the display portion 120 by controlling the scanning line driving circuit 121 and the data line driving circuit 122. The control by the controller 130 includes the control of the driving timing of the pixel 30.

The scanning line driving circuit 121 selects scanning lines $Y_1, Y_2, \ldots, Y_m$, and supplies the selected one scanning line with the scanning signal. The data line driving circuit 122 supplies data lines $X_1, X_2, \ldots, X_n$ with a data signal. The data signal is a signal that becomes any one of three types of electric potentials of +15 V, −15V, and 0 V (that is, the same electric potential as a common electric potential $V_{com}$) to the common electric potential $V_{com}$. The electric potential corresponds to the driving voltage value of the wave form table, +15 V corresponds to Vb, −15V corresponds to Vw, and 0 V corresponds to Vn, respectively. In addition, the number of scanning lines and data lines, that is, the values of m and n are not particularly limited.

The display panel 123 has a plurality of pixels 30 that is arranged in a matrix shape so as to correspond to the intersection of the data lines $X_1$ to $X_n$ and the scanning lines $Y_1$ to $Y_m$. The plurality of pixels 30 is electrically connected to a common electric potential line 124, and the common electric potential $V_{com}$ is applied from a feeder circuit (not shown). In addition, although it is described such that the data lines $X_1$ to $X_n$ are perpendicular to the scanning lines $Y_1$ to $Y_m$ in the drawings, the arrangements of the pixels 30 need not necessarily to be perpendicular to each other.

Figure 5:
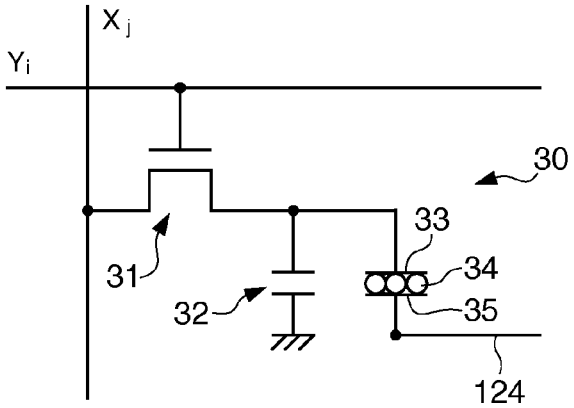
FIG. 5 is a diagram that shows an equivalent circuit of a pixel.

FIG. 5 is a diagram that shows an equivalent circuit of the pixels 30. As shown in FIG. 5, the pixel 30 includes a transistor 31, a retention volume 32, a pixel electrode 33, an electrophoretic layer 34, and a counter electrode 35. The transistor 31 is an element that functions as a switching element, and is, for example, an N type thin film transistor. The transistor 31 is configured so that a gate electrode is electrically connected to a scanning line $Y_i$ (i=1 to m), a source electrode is electrically connected to a data line $X_j$ (j=1 to n), and a drain electrode is electrically connected to the retention volume 32 and the pixel electrode 33, respectively. The transistor 31 supplies the retention volume 32 and the pixel electrode 33 with the data signal at the timing depending on the scanning signal.

The retention volume 32 has a pair of electrodes that face each other via a dielectric film, of which one electrode is electrically connected to the transistor 31, and the other electrode is electrically connected to a ground. The retention volume 32 is connected to the electrophoretic layer 34 in parallel and can keep the data signal supplied from the transistor 31 for a certain period of time.

The pixel electrode 33 is an electrode corresponding to each pixel 30, and the counter electrode 35 is an electrode that is commonly provided in each pixel 30. The electric potential of the counter electrode 35 is connected to the common electric potential line 124 and is kept in the common electric potential $V_{com}$. Meanwhile, the electric potential of the pixel electrode 33 is changed depending on the data signal. The electrophoretic layer 34 is a layer having a plurality of micro capsules enclosed with electrophoretic particles, and changes the state depending on the electric potential difference (that is, the driving voltage) between the pixel electrode 33 and the counter electrode 35.

Figure 6:
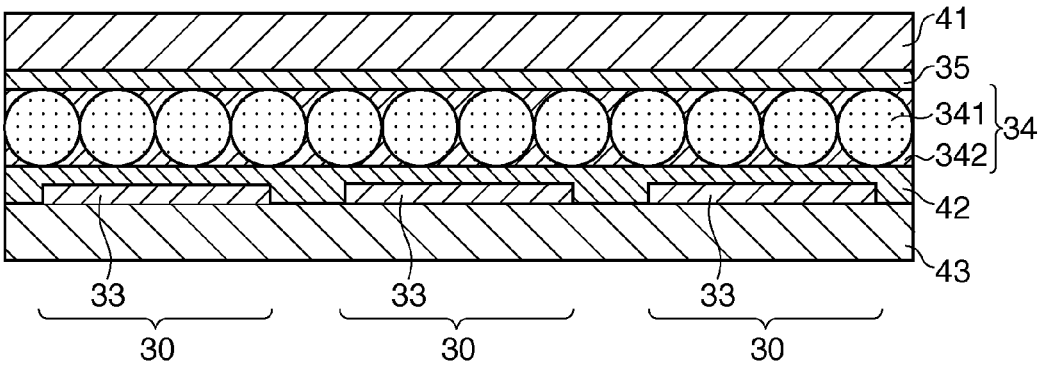
FIG. 6 is a partial cross-sectional view that shows a configuration of a display panel.

FIG. 6 is a partial cross-sectional view that shows a configuration of the display panel 123. As shown in FIG. 6, the display panel 123 includes a counter substrate 41, the counter electrode 35, the electrophoretic layer 34, an adhesion layer 42, the pixel electrode 33, and the element substrate 43. That is, the display panel 123 has a configuration in which the electrophoretic layer 34 is interposed by a pair of substrates (the counter substrate 41 and the element substrate 43). In addition, the display panel 123 constitutes the substrate or the like by a material having flexibility such as plastic, and may be bent to some extent, but may use a glass substrate.

The counter substrate 41 is a transparent substrate that has a counter electrode 35 provided on one surface. The counter electrode 35 is a transparent conductive film formed of indium tin oxide (ITO) or the like. A user can perceive the color of the electrophoretic layer 34, that is, the display state by sighting the display panel 123 from the counter substrate 41 side (an upper part of the drawing).

The electrophoretic layer 34 includes a plurality of micro capsules 341 and a binder 342. The micro capsules 341 are spherical capsules enclosed with coloring particles (also called electrophoretic particles, in the present embodiment, white particles and black particles) and a dispersion medium selected depending on the display states, and is an example of the electrophoretic element. The coloring particles are enclosed in the micro capsule 341 in a charged state, and are able to move in the capsule depending on the electric field generated by the driving voltage. In the present embodiment, the black particle having a positive electric charge and the white particle having a negative electric charge are used as the electrophoretic particles. Of course, it is also possible to use the black particle having the negative electric charge and the white particle having the positive electric charge. The binder 342 is formed of resin or the like and holds the micro capsule 341 so as not to be moved. The adhesion layer 42 is a layer for bonding the electrophoretic layer 34 to the element substrate 43 side.

The pixel electrode 33 is an electrode that is provided in a matrix shape in response to the intersection of the scanning line $Y_j$ and the data line $X_i$, and the position thereof corresponds to the arrangement of the pixel 30. The element substrate 43 is a substrate on which a circuit element constituting the pixel 30 is mounted in addition to the pixel electrode 33. Although it is not shown, the element substrate 43 has the transistor 31, the retention volume 32, the scanning line $Y_j$, the data line $X_i$ or the like mounted thereon.

The hardware configuration of the display device 100 is as stated above. Under this configuration, the CPU 110 controls the overall operation of the display device 100. Furthermore, the controller 130 accesses the ROM 140, the RAM 150, and the VRAM 151 depending on the operation of the CPU 110 to perform the writing (that is, the recording) and the reading (that is, the acquisition) of the data, and rewrites the image to be displayed on the display portion 120. In addition, the writing of the image data by the CPU 110 to the VRAM 151 is performed independently from the operation by the controller 130. Thus, the CPU 110 is able to rewrite the image data of the VRAM 151 regardless of the operation conditions of the controller 130.

Figure 7:
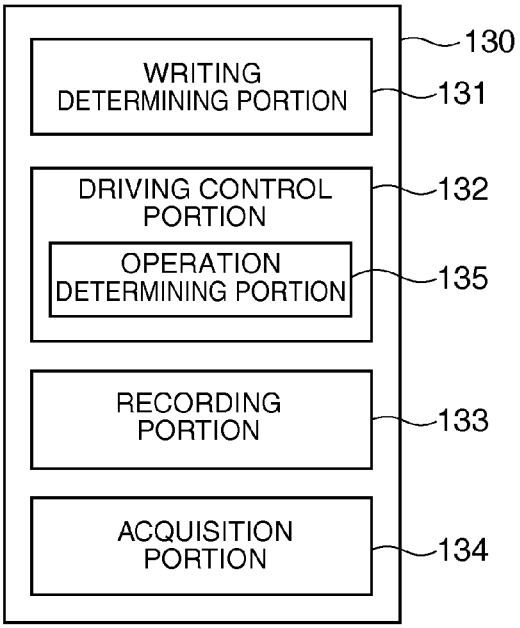
FIG. 7 is a functional block diagram that shows a functional configuration of a controller.

FIG. 7 is a functional block diagram that shows a functional configuration of the controller 130. The controller 130 is functionally classified into a writing determining portion 131, a driving control portion 132, a recording portion 133, and an acquisition portion 134 shown in FIG. 7. Furthermore, the driving control portion 132 has a function equivalent to an operation determining portion 135.

The writing determining portion 131 determines whether or not the writing operation is performed. The writing determining portion 131 executes the determination for each pixel. The controller 130 allows the writing operation to be independently performed for each pixel by deciding whether or not the writing operation is performed for each pixel. That is, the controller 130 can perform the writing operation of any pixel by the determination without relying on the writing operation of another pixel. The writing determining portion 131 is equivalent to an example of the determining portion according to the embodiment of the invention.

The driving control portion 132 controls the scanning line driving circuit 121 and the data line driving circuit 122, and generates the scanning signal and the data signal at a predetermined timing, thereby controlling the starting and the finishing of the writing operation. The driving control portion 132 controls the scanning line driving circuit 121 and the data line driving circuit 122 so as to perform the writing operation on the pixel determined when the writing operation is performed by the writing determining portion 131. The driving control portion 132 applies the driving voltage to each pixel in a predetermined pattern by the use of the wave form table that is specified based on the table ID recorded on the RAM 150. The driving control portion 132 is equivalent to an example of the control portion according to the embodiment of the invention.

The operation determining portion 135 determines whether or not the writing operation is performed in advance for the pixel determined when the writing operation is performed by the writing determining portion 131. Herein, the writing operation performed in advance is different from the writing operation determined upon being performed by the writing determining portion 131, and refers to a writing operation in which the determination was made before the writing operation. Hereinafter, such a writing operation is referred to as "a previous writing operation (relative to the writing operation determined upon being performed by the writing determining portion 131". In short, the operation determining portion 135 is a section that determines whether or not the pixel determined when performing the writing operation by the writing determining portion 131 is in the state while the previous writing operation is executed.

The driving control portion 132 controls each pixel determined when performing the writing operation by the writing determining portion 131 so as to start the writing operation when the previous writing operation is not performed and so as to start the next writing operation after the previous writing operation is finished when the previous writing operation is performed. The driving control portion 132 is able to delay the next writing operation that is performed by performing such a control on the pixel in which the previous writing operation is not finished. Furthermore, the driving control portion 132 allows the delay to be performed in the pixel unit, whereby there is no need to wait for the writing operation to be performed on any pixel dependent on the operation state of another pixel (for example, adjacent pixels).

The recording portion 133 records the data on the RAM 150 depending on the progress of the writing operation. The recording portion 133 records the scheduled data, the table ID and the remaining number on the RAM 150. The recording portion 133 records new scheduled data by rewriting the scheduled data to the data corresponding to the pixel among the image data stored in the VRAM 151 whenever the writing operation of each pixel is started. Furthermore, the recording portion 133 records the table ID of the wave form table that is applied to each pixel when the writing operation is started. In addition, the recording portion 133 records the remaining numbers of each pixel when the writing operation of each pixel is started, and reduces the remaining number "one by one" (decrement) whenever the driving voltage is applied.

The acquisition portion 134 acquires the data from the ROM 140, the RAM 150, and the VRAM 151 depending on the progress of the writing operation. The acquisition portion 134 acquires the driving voltage value of the wave form table to be applied to the writing operation from the ROM 140, and acquires the image data from the VRAM 151. Furthermore, the acquisition portion 134 acquires the scheduled data, the table ID, and the remaining number from the RAM 150 as necessary.

Figure 8:
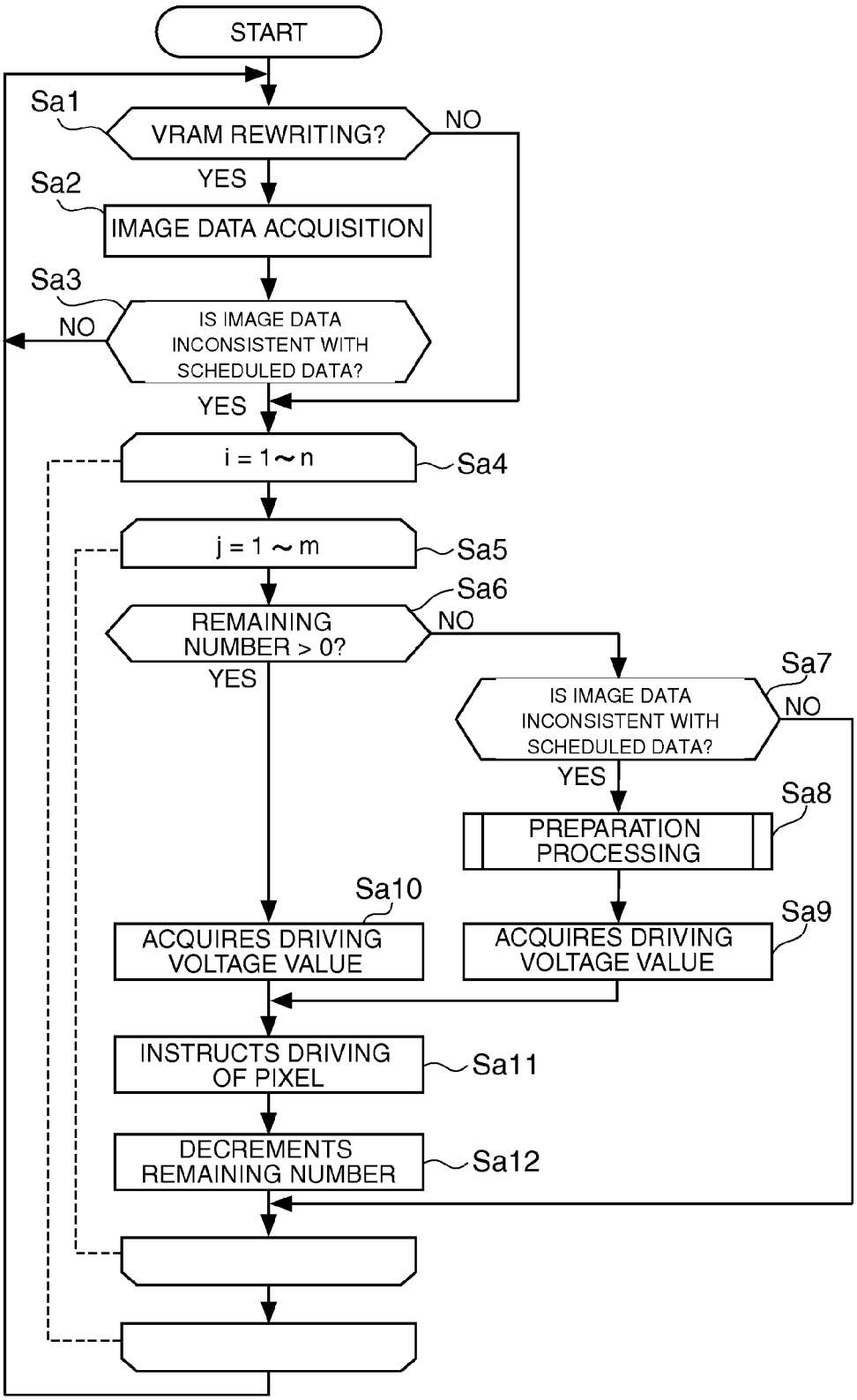
FIG. 8 is a flow chart that shows the processing to be executed by a controller.

FIG. 8 is a flow chart that shows the processing to be executed by the controller 130 having such a configuration. As shown in FIG. 8, the controller 130 determines whether or not the image data of the VRAM 151 is rewritten by the CPU 110 (step Sa1). For example, the determination is realized by the direct reference of the VRAM 151 by the controller 130. The controller 130 determines that the image data is rewritten when the image data stored in the VRAM 151 is different from the image data acquired previously (or when the image data is initially acquired such as immediately after the inputting of the power source). In addition, the controller 130 may acquire the image data from the VRAM 151 every time without performing the determination of step Sa1.

When it is determined that the image data is rewritten, the controller 130 acquires new image data from the VRAM 151 (step Sa2). Moreover, the controller 130 reads the scheduled data from the RAM 150, and determines whether or not there is a pixel, which is not consistent with the scheduled data, in the acquired image data (step Sa3). That is, the controller 130 determines whether or not the gradation values of each pixel are consistent with the image data and the scheduled data. The fact that the gradation values of the image data are entirely consistent with the gradation values of the scheduled data indicates that there is no need to perform a new writing operation (however, if there is a writing operation during execution, the writing operation itself is performed). Thus, it is considered that the determination of step Sa3 corresponds to the determination whether or not there is a need to perform a new writing operation. For example, the determination can be realized by a logical computation that acquires an exclusive logical sum of the gradation values of the corresponding pixels of the image data and the scheduled data. In addition, the controller 130 skips (omits) the processing of the steps Sa2 and Sa3 when it is determined that the image data is not rewritten.

When there is a pixel in which the gradation value of the image data is not consistent with the gradation value of the scheduled data, the controller 130 executes the processing for writing the pixel. Meanwhile, when the gradation values of the image data are entirely consistent with gradation values of the scheduled data, the controller 130 executes the processing after the step Sa1 without performing the writing operation. In this case, until the new image data is written on the VRAM 151, the controller 130 does not perform the writing operation, but repeatedly executes the processing of the steps Sa1 to Sa3.

The processing after step Sa4 is to select the scanning line of the driving target (that is, the writing target) in a predetermined order (an ascending order of i of $Y_i$) and drive the pixel of the driving target in a predetermined order (an ascending order of j of $X_j$). Herein, the scanning line (or the pixel) of the driving target may be all or a part of the scanning line (or the pixel). That is, the controller 130 is able to partially drive only a part of pixels of the display portion 120 but not all the pixels thereof.

The processing of the step Sa4 is a loop processing that sequentially selects the scanning line of the driving target.

Herein, the controller 130 repeats the loop processing until the scanning lines of the driving target are entirely selected one by one. That is, the finish condition of the loop processing is that the unselected scanning line of the driving target disappears. Furthermore, the processing of the step Sa5 is a loop processing that is executed on each pixel on the scanning line selected in the step Sa4. That is, the controller 130 repeats the processing after step Sa6 while sequentially changing the pixels of the processing target. In addition, in the following, the pixel of the processing target is referred to as "a pixel for attention".

In step Sa6, the controller 130 determines whether or not the remaining number recorded on the RAM 150 in regard to the pixel for attention is greater than "0". The determination is equivalent to the determination whether or not the writing operation is performed on the pixel for attention. The remaining number is always greater than "0" if the writing operation is being performed. Meanwhile, since, if the remaining number is "0", the writing operation is finished, the state, in which the remaining number is "0", corresponds to the state in which the writing operation started previously is finished (or the state in which the writing operation is not performed even once). Thus, when a new writing operation is started, the value of the remaining number is "0".

When the remaining number is "0", that is, when a new writing operation can be started, the controller 130 determines whether or not the gradation values of the pixel for attention are coincident with the image data of the VRAM 151 and the scheduled data of the RAM 150 (step Sa7). The determination is different from the determination of the step Sa3 in that the comparison of the image data with the scheduled data does not use a plurality of pixels as a unit (that is, a screen unit) but uses individual pixels as a unit. When the gradation values are consistent with each other, the controller 130 does not perform the writing operation on the pixel for attention. Meanwhile, when the gradation values are not consistent with each other, the controller 130 executes the processing (hereinafter, referred to as "a preparation processing") for starting the writing operation (step Sa8).

Figure 9:
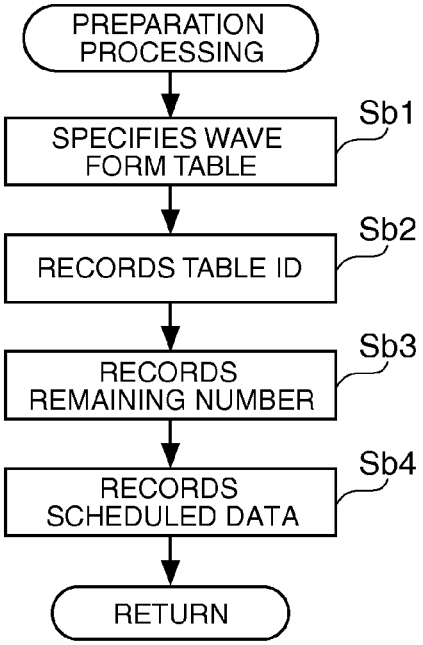
FIG. 9 is a flow chart that shows a preparation processing.

FIG. 9 is a flow chart that shows a preparation processing. The preparation processing is a processing that is executed once before starting the writing operation but is not executed while the writing operation is executed (that is, when the remaining number is not "0"). In other words, the preparation processing is a processing to record the data required for the execution of the writing operation.

In the preparation processing, the controller 130 firstly specifies the wave form table that is used for the pixel for attention (step Sb1). The controller 130 is able to specify the wave form table by referring to the image data stored in the VRAM 151 and the scheduled data stored in the RAM 150. Specifically, the wave form table, in which the gradation value of the scheduled data of the pixel for attention is set to an initial value and the gradation value of the image data is set to an objective value, is a wave form table used for the pixel for attention. Otherwise, when the writing is not performed on the pixel for attention even once, the initial value of the gradation value is 100% (that is, white).

When the wave form table is specified in this manner, the controller 130 specifies the table ID of the specified wave form table and records the table ID on the RAM 150 (step Sb2). In addition, the controller 130 stores the table ID corresponding to any pixel and the table ID corresponding to another pixel in a distinguishable manner. Next, the controller 130 records the maximum value of the index of the specified wave form table on the RAM 150, and sets the same as the remaining number (step Sb3). In addition, the controller 130 rewrites the scheduled data of the pixel for attention by the image data of the pixel for attention (step Sb4). That is, the controller 130 records (overwrites) the scheduled data of the pixel for attention so that the image data becomes the new scheduled data. The processing of step Sb4 is also a processing for making the scheduled data usable as the initial value of the gradation value when the next writing operation is performed.

In addition, the execution order of each step of the preparation processing can be changed. For example, the processing of step Sb2 and the processing of step Sb3 may reverse the order of execution. Furthermore, the processing of step Sb4 may be executed before the processing of step Sb1. However, the processing of steps Sb2 and Sb3 cannot be executed before the wave form table is specified.

When the preparation processing is finished, the controller 130 acquires the driving voltage value used in the driving of the pixel for attention (step Sa9). The controller 130 specifies the necessary wave form table and the index by reading the table ID and the remaining number recorded in the preparation processing, and acquires the driving voltage value corresponding to the specified index. Moreover, the controller 130 instructs the display portion 120 to drive the pixel for attention by the acquired driving voltage value (step Sa11). After that, the controller 130 decrements the remaining number stored in the RAM 150 (step Sa12) and finishes the processing for the pixel for attention.

The first application of the driving voltage in the writing operation is performed as mentioned above. Meanwhile, the application of the driving voltage after the second time in the same writing operation is performed as below. In addition, determining the application of the driving voltage to be after the second time is a case where it is determined that the remaining number is greater than "0" in step Sa6.

In step Sa6, when the remaining number is determined to be greater than "0", the controller 130 acquires the driving voltage value used for the driving of the pixel for attention by the same trick as the case of step Sa9 (step Sa10). For example, when the second driving voltage value is acquired in any writing operation, the controller 130 can acquire the corresponding driving voltage value by reading the table ID recorded for the preparation processing and the remaining number decremented from the initial remaining number by one time. After that, the controller 130 instructs the display portion 120 to drive the pixel for attention by the acquired driving voltage value (step Sa11), decrements the remaining number stored in the RAM 150 again (step Sa12), and finishes the processing.

In addition, when the driving voltage is repeatedly applied to the pixel for attention (that is, the remaining number is decremented) and the number of applications reaches a scheduled number (that is, when the remaining number is "0"), in the determination of step Sa6 to be performed after that, "YES" is determined. Thus, the controller 130 determines the difference between the image data and the scheduled data of the pixel for attention again (step Sa7). At this time, if the image data of the VRAM 151 is not rewritten from when the writing operation is started, the determination of step Sa7 is "NO". The reason is that the scheduled data is rewritten to the image data in step Sb4 in the preparation processing. Meanwhile, when the image data of the VRAM 151 is rewritten from when the writing operation is started, the determination of step Sa7 is "YES". In this case, the controller 130 is able to execute the preparation processing again and start a new writing operation.

As mentioned above, according to the display device 100 of the present embodiment, it is determined whether or not the writing operation is performed for each pixel, and the starting and the finishing of the writing operation can be controlled in the pixel unit. Thus, it is possible to start the writing operation without being affected by the operation state of another pixel. Accordingly, the display device 100 is able to increase a region where the writing operation can be started without relying on the writing operation being executed (that is, the previous writing operation), as compared to a case where the writing is performed for each partial region (constituted by a plurality of pixels).

Furthermore, according to the display device 100, even when the image data of the VRAM 151 is rewritten during the writing operation, the rewriting of the image data does not affect the writing operation until the remaining number is "0". That is, the controller 130 is operated regardless of the rewriting of the image data of the VRAM 151 until the writing operation of the pixel for attention is finished, and determines whether or not the next writing operation is performed after the writing operation is finished. By doing this, when the rewriting of the image data is performed several times during the writing operation, it is possible that the writing of the pixels for attention at the mid-point (other than the final one) may not be reflected on the actual display, and it is expected that the pixels for attention will more quickly enter a desired display state. The effect is more remarkable as the number of applications per writing operation is increased. Similarly, for example, when an objective value of the pixel for attention due to any writing operation is consistent with an objective value of the pixel after several rewriting of the image data, it is also possible to omit a writing operation after the writing operation so as not to be performed.

In addition, the display device 100 has a characteristic that does not need to perform the management or the like of the writing operation for each pixel when viewed from the side operating the CPU 110 and may simply write the image data to be displayed on the VRAM 151. By such a characteristic, a developer of an application to be operated by the CPU 110 is able to produce an application that does not need to consider the display state or the writing operation state of each pixel.

MODIFIED EXAMPLE

The invention can also be implemented in various forms described below. In addition, the modified example or the application example described below may be suitably combined with each other as necessary.

Modified Example 1

The data showing the pattern of the driving voltage is not limited to a so-called table type. The data showing the pattern of the driving voltage may be, for example, described using the concept of the pointer or the arrangement in the programming. Furthermore, the data showing the pattern of the driving voltage need not be one in which the driving voltage value and the remaining number correspond to each other in a one-to-one relationship. For example, the data corresponding to the wave form table T1 of FIG. 2 may describe the driving voltage value and the number to be applied, for example, after applying the driving voltage value "Vw" "once", the driving voltage value "Vn" is applied "once".

Modified Example 2

The data for specifying the pattern of the driving voltage need not be an ID for identifying the pattern. For example, in the aforementioned embodiment, if the pattern of the driving voltage is uniquely specified by the combination of the initial value and the objective value of the gradation, the controller 130 may record the initial values of the gradations of each pixel instead of the table ID in the preparation processing. By doing so, it is possible to specify the required wave form table by the recorded initial value and the scheduled data (that is, the objective value).

In addition, the wave form table can also be shared between the different initial values or objective values of the gradation. For example, the substantial contents of the wave form tables T2 and T6 shown in FIG. 2 are identical to each other. When the wave form table can be shared, it is possible to reduce the storage region required for the storage of the wave form table.

Modified Example 3

The pattern of the driving voltage of any writing operation can be determined in view of other factors as well as the initial value and the objective value of the gradation of the pixel. For example, when the responsiveness of the display element differs depending on the temperature and the display element includes a sensor that detects the temperature, the pattern of the driving voltage may be determined by the initial value, the objective value, and the temperature of the gradation of the pixel. Alternatively, when the pattern of the driving voltage in a certain writing operation to a certain pixel is determined, it is also possible to consider the initial value (or the pattern of the driving voltage) of the gradation in the previous writing operation relative to the writing operation.

Modified Example 4

In an embodiment of the invention, the number of applications in one writing operation may be variable depending on the initial value or the objective value of the gradation (or both of them), but may be constant regardless of the gradation. When the number of applications in the one writing operation is constant, the controller 130 may perform a fixed number of voltage applications on the pixel of the writing target without performing the recording of the remaining number (step Sb3) or the like.

Modified Example 5

The number of gradations realizable in the invention is not particularly limited. For example, if the number of applications in the one writing operation is increased, it is possible to realize the number of gradations greater than that of the aforementioned embodiment (four gradations). Furthermore, the invention can also be applied to the display of two gradations that do not include a halftone.

Modified Example 6

In the aforementioned embodiments, the data corresponding to the remaining number may be data that can specify the number of applications of the driving voltage to the one writing operation. For example, the controller 130 may record the occasional number of applications on the RAM 150 instead of the remaining number. In this case, the controller 130 is able to obtain the remaining number by performing the computation of reducing the number of applications recorded on the RAM 150 from the total number of the number of applications required for the one writing operation. At this time, the controller 130 may perform the increment (an addition of the number of applications) instead of the decrement in step Sa12.

Modified Example 7

The configuration of the display panel 123 is not limited to that shown in FIG. 6. For example, the electrophoresis layer is not limited to the configuration including a plurality of micro capsules, but may be a configuration in which the dispersion medium and the electrophoresis particle are included in the space divided by a partition. Furthermore, in the aforementioned embodiments, a case is assumed where the black and white display is implemented using the black and white two types of electrophoresis particles, one of them having the positive electric charge and the other having the negative electric charge, as the electrophoresis element. However, the invention can be applied to a display using a concentration change of two directions such as red and white or blue and black by means of a difference in concentration.

Furthermore, the display element according to the embodiment of the invention is not limited to the electrophoresis element. As the display element according to the embodiment of the invention, a display element may be used which uses, for example, a cholesteric liquid crystal, an electrochromic substance, an electronic powder fluid or the like.

Modified Example 8

The aforementioned embodiment is an example in which the display by the display device 100 is realized by the cooperation of the CPU 110 and the controller 130. However, the invention may also be realized by a single component (for example, a CPU simple substance) without relying on the cooperation. In this case, the invention can also be provided as a program for realizing the control device according to the embodiment of the invention in a computer such as a CPU, or a recording medium that records such a program.

Application Example

The invention can be applied to various types of electronic equipment including the display device. The invention is especially suitable for the utilization in the electronic equipment (for example, portable electronic equipment, small electronic equipment or the like) that requires a low consumption electric power if the display element having the memory property is used. Furthermore, the invention is especially suitable even for the application that frequently uses the partial writing of the screen.

Figure 10A:
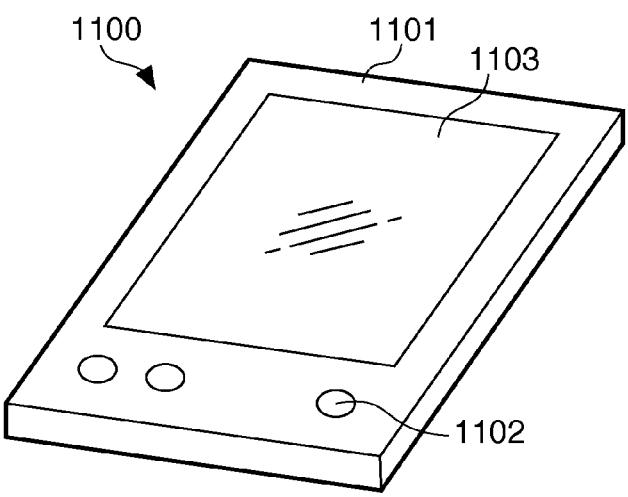
FIGS. 10A and 10B are diagrams that show electronic equipment to which the display device according to an aspect of the invention is applied.
Figure 10B:
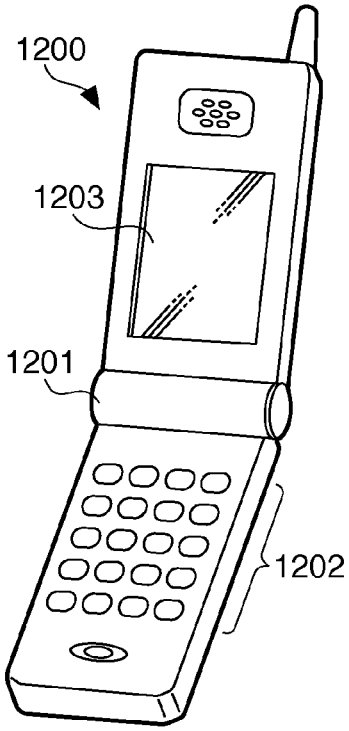

FIGS. 10A and 10B are diagrams that show electronic equipment to which the display device according to the embodiment of the invention is applied. FIG. 10A is a diagram that shows an exterior of a reader for reading a document such as a so-called electronic book. In FIG. 10A, a reader 1100 includes a case 1101, an operation portion 1102 that receives the operation of a user, and a display portion 1103 to which the invention is applied. In addition, it is also possible to make the reader 1100 a so-called flexible display by being formed of a material that can bend or curve the case 1101 and the display portion 1103.

Furthermore, the reader 1100 is able to receive the operation of a user in the display portion 1103 by providing a touch screen in the display portion 1103. In the case of such a configuration, the reader 1100 is also able to display handwriting letters or lines by driving the pixel corresponding to the region receiving the operation by the touch screen to change the gradation.

FIG. 10B is a diagram that shows an exterior of a mobile phone. In FIG. 10B, a mobile phone 1200 includes a case 1201, an operation portion 1202 such as a key pad, and a display portion 1203 to which the invention is applied. In addition, when the mobile phone 1200 has a plurality of display regions, the display device according to an embodiment of the invention may be applied to one (for example, a sub display), and another display device may be applied to the other (for example, a main display).

In addition, the present invention can also be applied to a personal computer, a PDA (Personal Digital Assistant), a radio communication terminal such as a smart phone, an electronic dictionary, a digital type clock or the like.

The entire disclosure of Japanese Patent Application No. 2010-186338, filed Aug. 23, 2010 is expressly incorporated by reference herein.

What is claimed is:

1. A control device that controls the driving of a display device which changes display states of a plurality of pixels from a first display state to a second display state by a writing operation of applying a driving voltage several times, the control device comprising:

a determining portion that determines whether or not the writing operation is to be performed for each of the plurality pixels; and a control portion that starts the writing operation in each of the plurality pixels in which the writing operation is determined to be performed by the determining portion, the writing operation including applying the driving voltage to each of the plurality pixels several times in a pattern, the pattern being determined depending on the first display state and the second display state, wherein, when a previous writing operation is completed on one of the plurality of pixels, the control portion starts a next writing operation if the next writing operation is determined to be performed on the one of plurality of pixels by the determining portion, and in a case where the previous writing operation is still being performed on the one of plurality of pixels, the control portion delays the start of the next writing operation until after the writing operation currently being performed is finished.

2. The control device according to claim 1, wherein the number of applications of the driving voltage in one writing operation differs depending on at least one of the first display state and the second display state.

3. The control device according to claim 1, further comprising:

a first recording portion that records data for specifying the number of applications of the driving voltage in the one writing operation for each pixel, wherein the control portion determines whether or not the previous writing operation is performed, depending on whether or not the number specified by the data recorded by the first recording portion reaches a scheduled number.

4. The control device according to claim 1, wherein, when the previous writing operation is still being performed on the one of the plurality of pixels for which the writing operation is determined to be performed, the determining portion performs the determination again after the previous writing operation is finished, and when it is determined that the writing operation is not to be performed according to the repeated determination by the determining portion, the control portion does not perform the writing operation.

5. The control device according to claim 1, further comprising:

an acquisition portion that reads and acquires an image data from a first storage region which stores the image data showing display states to be displayed on each of the plurality of pixels; and a second recording portion that records a scheduled data, which shows a scheduled display state to be displayed on each of the plurality of pixels when the writing operation is finished, on an individual pixel based, wherein the determining portion determines the whether or not the writing operation is to be performed for each of the plurality of pixels by identifying pixels, in which the display state shown by the image data acquired by the acquisition portion is not consistent with the display state shown by the scheduled data.

6. The control device according to claim 5, wherein the second recording portion rewrites the scheduled data for one of the plurality pixels in which the writing operation is started by the control portion so that the image data becomes new scheduled data.

7. A display device comprising:

the control device according to claim 1; and a display portion that has a plurality of pixels and performs the writing operation depending on the control by the control device.

8. The display device according to claim 7, wherein the plurality of pixels each include a display element having a memory property.

9. A control method by a section that controls the driving of a display device which changes display states of a plurality of pixels from a first display state to a second display state by a writing operation of applying a driving voltage several times, the method comprising:

determining whether or not the writing operation is to be performed for each of the plurality of pixels; and controlling so that the writing operation is started in each of the plurality of pixels in which the writing operation is determined to be performed, the writing operation including applying the driving voltage to each of the plurality of pixels several times in a pattern, the pattern being determined depending on the first display state and the second display state, wherein, in a case where a previous writing operation is completed on one of the plurality of pixels, a next writing operation is started if the next writing operation is determined to be performed on the one of the plurality of pixels, and in a case where the previous wiring operation is still being performed on the one of the plurality of pixels, the next writing operation is delayed from starting until after the writing operation currently being performed is finished.

10. The control device according to claim 1, wherein the control portion applies a data signal each of the several times to the display device, and wherein the determining portion receives imaging data asynchronously with the supply of each of the data signals.

* * * * *